US011420457B2

(12) United States Patent
Hanawa et al.

(10) Patent No.: US 11,420,457 B2
(45) Date of Patent: Aug. 23, 2022

(54) RECORDING APPARATUS

(71) Applicant: SEIKO EPSON CORPORATION, Tokyo (JP)

(72) Inventors: Keita Hanawa, Matsumoto (JP); Kensuke Tamai, Shiojiri (JP); Katsumi Yamada, Matsumoto (JP); Tatsuya Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/224,442

(22) Filed: Apr. 7, 2021

(65) Prior Publication Data

US 2021/0316562 A1 Oct. 14, 2021

(30) Foreign Application Priority Data

Apr. 10, 2020 (JP) ..... JP2020-070870

(51) Int. Cl.
*B41J 25/308* (2006.01)

(52) U.S. Cl.
CPC ..... *B41J 25/308* (2013.01)

(58) Field of Classification Search
CPC ... B41J 25/308; B41J 25/3082; B41J 25/3086
See application file for complete search history.

(56) References Cited

U.S. PATENT DOCUMENTS

2014/0009518 A1* 1/2014 Kumagai ..... B41J 25/3082 347/8
2015/0009263 A1* 1/2015 Nakata ..... B41J 25/3082 347/37

FOREIGN PATENT DOCUMENTS

JP 2014-014938 1/2014
JP 2018176434 A * 11/2018 ..... B41J 2/1752

OTHER PUBLICATIONS

Yamabe, MachineTranslationofJP-2018176434-A, 2018 (Year: 2018).*

* cited by examiner

*Primary Examiner* — Scott A Richmond
(74) *Attorney, Agent, or Firm* — Workman Nydegger

(57) ABSTRACT

An apparatus includes a gap adjuster that adjusts a gap in a vertical direction between a recording head and a supporting surface for supporting a medium. The gap adjuster adjusts the gap by engagement of a carriage, a slide member, and a cam member that is provided therebetween and has a stepped portion with an alternate-arrangement structure in a width direction. The gap adjuster includes a coil spring that urges the carriage with respect to the slide member in the direction that is the opposite of the transportation direction. A slide contact member is provided on an end of the coil spring.

8 Claims, 15 Drawing Sheets

RECORDING APPARATUS

The present application is based on, and claims priority from JP Application Serial Number 2020-070870, filed Apr. 10, 2020, the disclosure of which is hereby incorporated by reference herein in its entirety.

BACKGROUND

1. Technical Field

Embodiments of the present disclosure relate to a recording apparatus.

2. Related Art

In related art, a recording apparatus that includes a mechanism for adjusting in multiple steps a gap between a recording head and a supporting surface for supporting a medium is known. For example, a gap adjuster of a recording apparatus disclosed in JP-A-2014-14938 includes a slide member configured to move in a width direction together with a carriage and includes a cam member configured to cause the carriage to move in a vertical direction, and switches a gap in multiple steps by means of the slide member and the cam member.

The recording apparatus disclosed in JP-A-2014-14938 includes coil springs that urge the carriage with respect to the slide member in a predetermined direction. Slide operation of the end surface of the coil spring and the carriage is performed when the gap is switched. However, in related art, there is a possibility that print quality might decrease because a desired gap cannot be obtained due to obstruction of the slide operation of the end surface of the coil spring by the spring end.

SUMMARY

A recording apparatus according to a certain aspect of the present disclosure includes: a recording head that performs recording on a medium that is transported; a carriage on which the recording head is mounted and which is configured to move in a width direction intersecting with a transportation direction of the medium; a guide member that extends in the width direction and guides the carriage in the width direction; and a gap adjuster that causes the carriage to change in position in a first direction in which a gap between the recording head and a supporting surface for supporting the medium at a position facing the recording head changes, the gap adjuster including a slide member that moves in the width direction together with the carriage while sliding on the guide member; a cam member provided between the carriage and the slide member and having a stepped portion in which keeping surfaces for keeping the position of the carriage in the first direction and adjustment surfaces for changing the position of the carriage in the first direction are arranged alternately in the width direction; and a first urging member that urges the carriage with respect to the slide member in a direction that is opposite of the transportation direction; wherein the first urging member is equipped with a slide contact member that slides on the carriage.

DESCRIPTION OF EXEMPLARY EMBODIMENTS

First, the outline of a recording apparatus according to an exemplary embodiment of the present disclosure will now be described. In the present embodiment, a serial-type ink-jet multifunction printer 1 is taken as an example of a recording apparatus. In the X-Y-Z coordinate system illustrated in each drawing, the X direction represents a width direction or a scan direction, the Y direction represents a depth direction or a direction parallel to a sheet-transportation direction, and the Z direction represents a height direction or a vertical direction or a first direction. The direction indicated by the head of the Y-directional arrow will be referred to as "frontward" or "downstream". The direction indicated by the tail of the Y-directional arrow will be referred to as "rearward" or "upstream". As viewed from the front of the apparatus, "left" is defined as the side indicated by the head of the X-directional arrow, and "right" is defined as the side indicated by the tail of the X-directional arrow. The direction indicated by the head of the Z-directional arrow will be referred to as "vertically upward", and the direction indicated by the tail of the Z-directional arrow will be referred to as "vertically downward" or the direction of gravity. The sheet-transportation direction is the direction from the tail toward the head of the Y-directional arrow.

Figure 1:
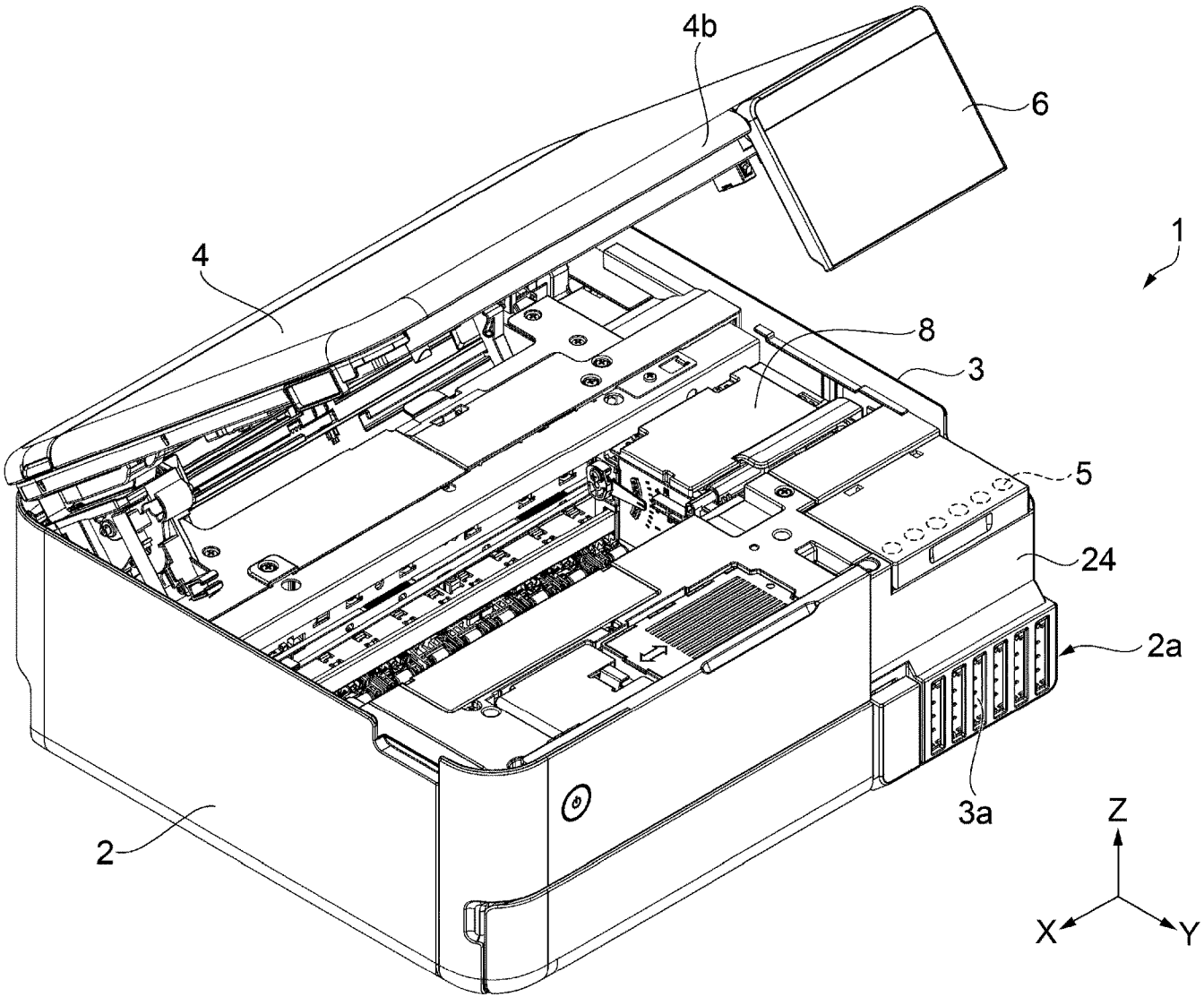
FIG. 1 is an internal perspective view of an ink-jet multifunction printer according to an exemplary embodiment.

The ink-jet multifunction printer 1 illustrated in FIG. 1 includes a printer unit 3 and a scanner unit 4. The printer unit 3 includes a recording unit 8 housed inside a box-shaped housing 2 and configured to perform recording on a medium P. The scanner unit 4 is mounted over the printer unit 3 and reads a document image.

Figure 2:
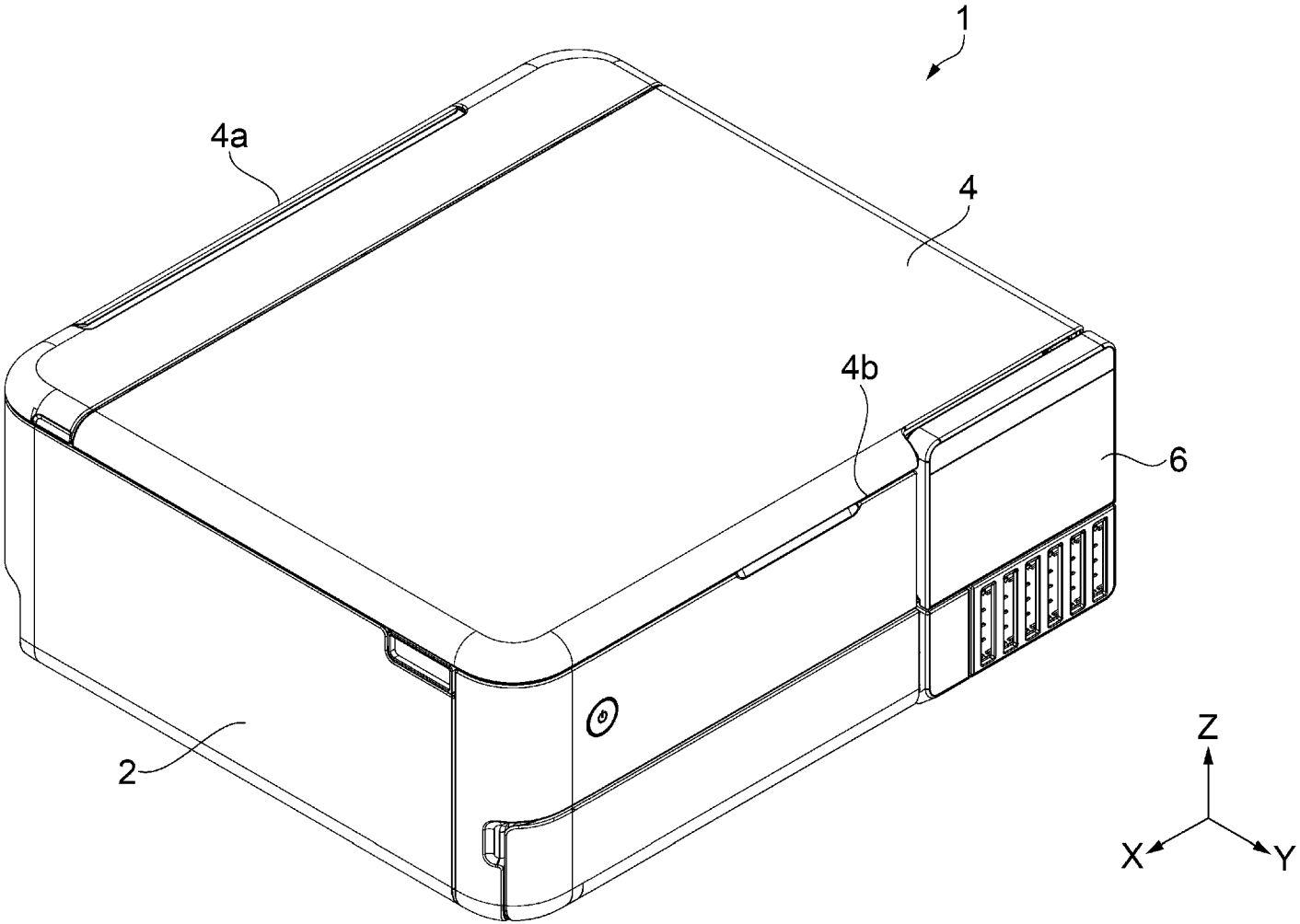
FIG. 2 is an external perspective view of the ink-jet multifunction printer.

The scanner unit 4 is provided over the printer unit 3 rotatably. As illustrated in FIG. 2, the scanner unit 4 has a pivot shaft 4*a* at the rear of the housing 2 along the X direction and is able to pivot such that the front of the housing 2 turns as a free end 4*b*. By rotating, the scanner unit 4 fulfills a function of an openable-and-closable cover for opening the top of the printer unit 3.

Figure 3:
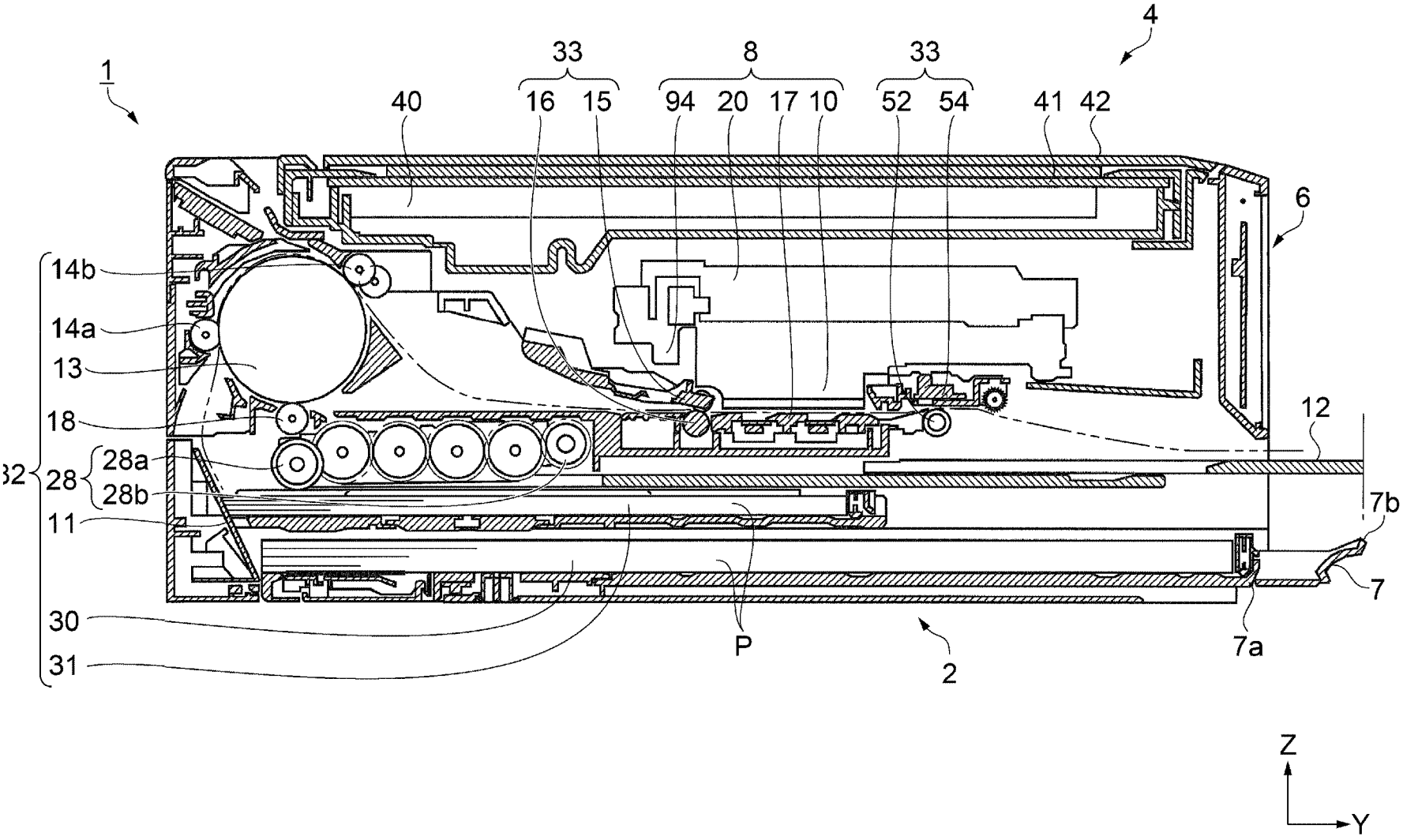
FIG. 3 is a sectional view of the ink-jet multifunction printer taken along a plane parallel to the YZ plane.

As illustrated in FIG. 3, the scanner unit 4 includes a scanner mainframe 40, which is equipped with a non-illustrated reader inside, and a document table cover 42, which can be opened and closed for a document table 41 provided at the top of the scanner mainframe 40. The document table cover 42 can be opened and closed alone. The document table 41 becomes exposed when the document table cover 42 is opened. The reader reads a document placed on the document table 41. The document is placed on the document table 41, with its reading target surface facing the document table 41.

An operation unit 6 for operating the scanner unit 4 is provided at the front of the apparatus. The operation unit 6 has a liquid crystal touch panel display function. The operation unit 6 can be used for performing various setting operations and execution operations for recording and image reading. In addition, the operation unit 6 is able to perform setting content display and image preview display, etc. Although the operation unit 6 is provided on the scanner unit 4, the operation unit 6 can be used also for, for example, paper type setting and ink replacement, which are functions of the printer unit 3.

The printer unit 3 includes the recording unit 8, a medium feeding unit 32, and a transportation unit 33. The recording unit 8 includes a recording head 10, which performs recording by ejecting ink toward the medium P that is transported, and a carriage 20, on which the recording head 10 is mounted and which reciprocates in the width direction intersecting with the transportation direction of the medium P. The medium feeding unit 32 includes a lower tray 30, which is able to accommodate a plurality of sheets of the medium P, and an upper tray 31. The transportation unit 33 transports the medium P fed from the medium feeding unit 32 to the recording unit 8 and ejects the medium P.

The printer unit 3 is configured to be refillable for replenishment of ink whose amount has decreased due to recording. As illustrated in FIG. 1, the printer unit 3 according to the present embodiment has a liquid container unit 24 provided at the front inside the housing 2. Refilling of the liquid container unit 24 with ink is performed with the scanner unit 4 opened. A cap 5 for closing an ink supply opening is provided on the top of each of the liquid containers 24. After opening the cap 5, a user is able to pour ink into the liquid container 24 from a separate ink bottle. Slits are provided at a part of the front 2*a* of the housing 2. Each of the liquid containers 24 has a window 3*a* that makes it possible to visually confirm the amount of ink contained in the liquid container 24 through the slit. The user is able to refill the liquid container 24 with ink properly while visually checking the amount of ink contained in the liquid container 24.

Figure 4:
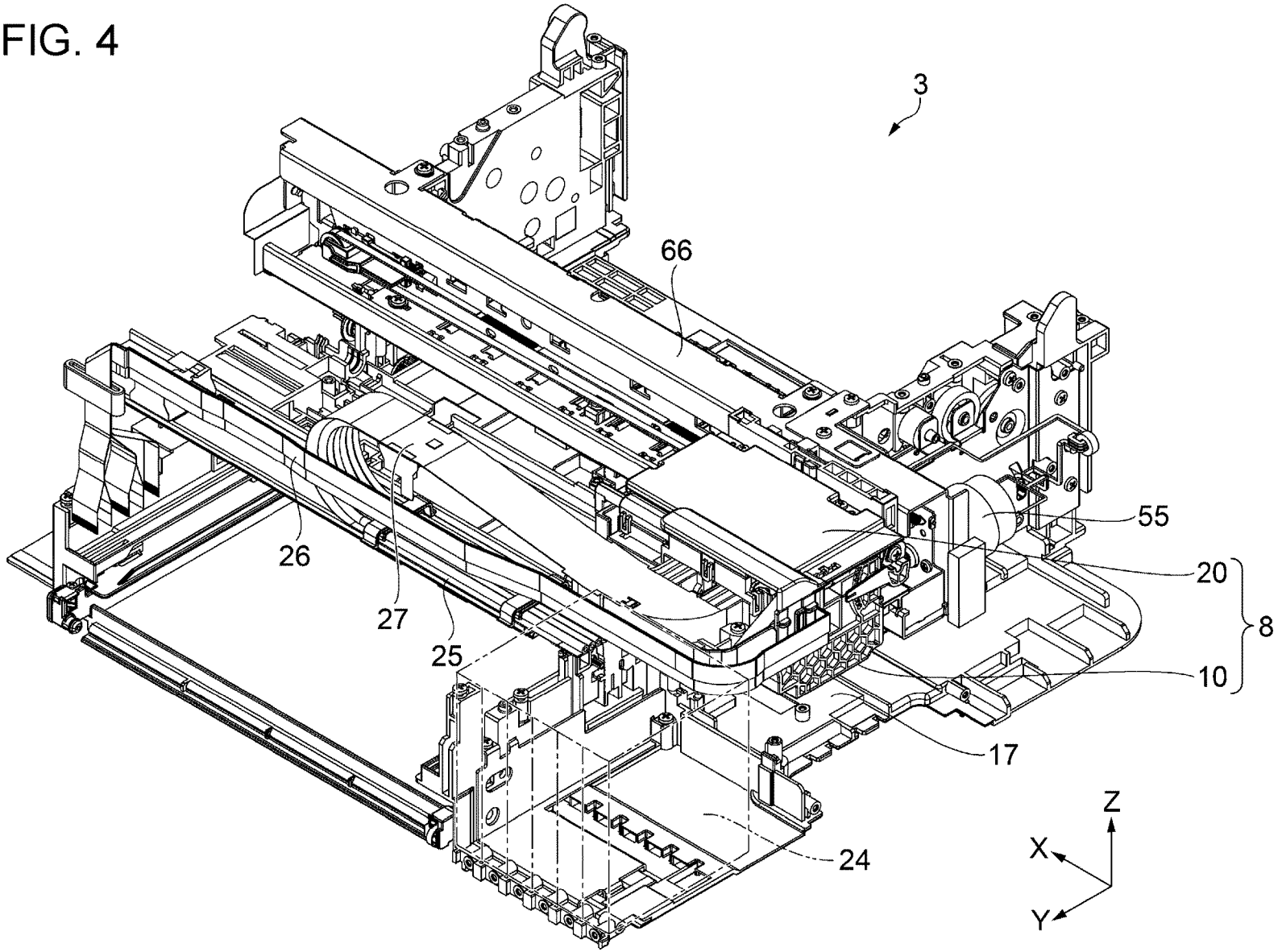
FIG. 4 is a perspective view of a printer unit.

As illustrated in FIG. 4, ink supply tubes 25 are provided along the width direction at a space in front of the carriage 20 and behind the liquid container unit 24. For each color, one end of the ink supply tube 25 is connected to the liquid container 24. The ink supply tubes 25 are arranged to extend in the X direction toward the opposite side in the width direction in relation to the position where the liquid container unit 24 is provided. The ink supply tubes 25 are fastened by being bound with binding bands together with the frame of the apparatus in a binding direction intersecting with the ink supply tubes 25 up to a halfway point in the scan width of the carriage 20. The ink supply tubes 25 bound with binding bands are bent back gently upward from the halfway-point one of the binding bands in such a way as to form a U-like curve and then extend approximately up to a position for connection to the liquid containers 24. The other end of each of the ink supply tubes 25 is inserted through the front of the housing of the carriage 20 to be connected to the recording head 10 of the corresponding color. A thin FPC restriction member 27 is provided on the ink supply tubes 25 bent upward in the U shape. The FPC restriction member 27 binds the ink supply tubes 25 in a binding direction intersecting with the ink supply tubes 25 and extends vertically down at the front side of the ink supply tubes 25. The FPC restriction member 27 is provided almost at a halfway point in the scan width of the carriage 20. However, the FPC restriction member 27 may be provided at any other arbitrary position in the X direction, or at a plurality of positions, on the ink supply tubes 25 bent upward in the U shape.

Flexible printed boards 26, each for communicating an ink ejection signal to the recording head 10, are provided in front of the FPC restriction member 27 substantially in parallel with a virtual extension line of the ink supply tubes 25. One flexible printed board 26 is needed for each color. The flexible printed boards 26 are stacked by taking advantage of their thin and flat shape and are bundled into one. With their flat surface oriented in the Y direction, the flexible printed boards 26 bundled into one are disposed to extend in the X direction from a position that is the opposite of the position where the liquid container unit 24 is provided. The flexible printed board 26 extending in this way is connected to the recording head 10 of each color from a far side with respect to the housing of the carriage 20. As explained above, in the printer unit 3 equipped with the serial-type recording head 10, the ink supply tubes 25 and the flexible printed boards 26 are provided adjacently at the space in front of the carriage 20 and behind the liquid container unit 24, which is space saving.

Assume that the carriage 20 located at the right-side position as illustrated in FIG. 4 travels leftward for scanning, and recording with this leftward scan is performed on the medium P that is transported. As the carriage 20 travels, the ink supply tubes 25 extending from the right moves while stretching out its upward-bent U-shaped portion leftward. Conversely, since the flexible printed boards 26 extend from the left, the slack of the flexible printed boards 26 becomes greater in the depth direction of the apparatus as the carriage 20 travels. When the slackening occurs, there is a risk that the flexible printed boards 26 with the slack might be run over by the carriage 20 coming from the right, resulting in damage. To avoid this from happening, the FPC restriction member 27, which has a plate-like portion extending vertically down with respect to the ink supply tubes 25, prevents the flexible printed boards 26 with increasing slackness from getting into the scan space of the carriage 20 while the carriage 20 travels.

As illustrated in FIG. 3, the printer unit 3 has a lower cover 7 at the lower portion of the front of the housing 2. The lower cover 7 has a pivot shaft 7*a* along the X direction at the lower-end portion of the lower cover 7. The upper-end portion of the lower cover 7 is a free end 7*b*. The lower tray 30 containing the medium P before recording is drawn out when the free end 7*b* of the lower cover 7 is pulled while being opened frontward. With the lower cover 7 opened, the user is able to access the upper tray 31 located at a rear position inside the apparatus.

In the printer unit 3, the lower tray 30 and the upper tray 31 of the medium feeding unit 32 are able to accommodate a plurality of sheets of the medium P and are detachable from the housing 2. The lower tray 30 and the upper tray 31 can be used selectively depending on the size of the medium P. In the ink-jet multifunction printer 1 according to the present embodiment, the lower tray 30 is able to contain, for example, A4-sized plain paper, glossy paper for photo use, thick paper such as cardboard paper, thin paper thinner than plain paper, and recording can be performed thereon. The upper tray 31 is able to contain, for example, thick paper such as postcards or envelopes, L-sized glossy paper for photo use, and recording can be performed thereon. Moreover, if a non-illustrated CD tray that comes as an accessory of the apparatus is inserted from the front of the opened lower cover 7, it is possible to perform recording on a label surface of a disc-type medium such as CD or DVD.

A sheet ejection tray 12 for receiving the medium P ejected after recording can be opened when the lower cover 7 is in an open state. The sheet ejection tray 12 is switchable between a housed state, namely, a state of being housed inside the housing 2, and a protruding state, namely, a state of protruding from the front of the housing 2. In the protruding state, the sheet ejection tray 12 is able to receive the medium P after recording. The sheet ejection tray 12 is able to be switched between the housed state and the protruding state by a driving source that is not illustrated.

A pickup roller 28*a*, which is driven to rotate by a non-illustrated motor that is a component of the medium feeding unit 32, is provided. The pickup roller 28*a* is provided on a pivot movement member 28 configured to pivot on a pivot shaft 28*b*. When the upper tray 31 is located at a position where sheet feeding can be performed, the pickup roller 28*a* rotates while being in contact with the top one of sheets of the medium P contained in the upper tray 31, thereby picking up the top one of sheets of the medium P out of the upper tray 31 and feeding it out onto a sheet feeding path. If, for example, the upper tray 31 is not attached, the pickup roller 28*a* rotates while being in contact with the top one of sheets of the medium P contained in the lower tray 30, thereby picking up the top one of sheets of the medium P out of the lower tray 30.

The medium P picked up is not always in a single-sheet separated state. To provide a solution for a case where multiple sheets of the medium P are picked up, a sheet separator 11 is provided at a position facing the leading edge of the medium P contained in the lower tray 30 and facing the leading edge of the medium P contained in the upper tray 31. The leading edge of the medium P picked up from the lower tray 30 or the upper tray 31 due to rotation of the pickup roller 28*a* comes into contact with the sheet separator 11, and the medium P is fed downstream along the sheet feeding path while being in contact with the sheet separator 11. As a result, the top sheet of the medium P is separated from the rest by the sheet separator 11. The medium P goes around a feeding roller 13 to pass through a nip between a first feeding driven roller 14*a* and the feeding roller 13 and next through a nip between a second feeding driven roller 14*b* and the feeding roller 13. Then, the medium P is fed to the transportation unit 33.

The transportation unit 33 includes a transportation drive roller 15, which is driven by a non-illustrated motor, and a transportation driven roller 16, which is in pressed contact with the transportation drive roller 15 and rotates together therewith by receiving a rotation force. The transportation unit 33 transports the medium P to the recording unit 8 located downstream thereof.

The carriage 20 of the recording unit 8 includes a gap adjuster 94 configured to change a gap between the recording head 10 and a supporting surface 17 for supporting the medium P at a position facing the recording head 10. As will be described in detail later, the gap adjuster 94 is a mechanism for adjustment into an optimum gap that is the best for reducing the scratching of the medium P with the recording head 10 and outputting a high-quality image, which is achieved by changing the position of the carriage 20 in the vertical direction depending on a different thickness of the medium P.

As illustrated in FIG. 4, the carriage 20 of the recording unit 8 is provided slidably on a guide member 66, which extends in the width direction and guides the carriage 20 in the width direction. Driven by a drive motor 55, the carriage 20 is able to scan the recording head 10 in the width direction of the medium P. The medium P is fed to the supporting surface 17 for supporting the medium P, and the carriage 20 is scanned in one direction while ejecting ink from the recording head 10. The medium P is fed forward, and the carriage 20 is scanned in the other direction while ejecting ink from the recording head 10. Recording is performed by repeating these operations.

As illustrated in FIG. 3, the medium P after recording by the recording unit 8 is nipped between a first roller 52 and a second roller 54 and is ejected onto the sheet ejection tray 12 that is in a state of protruding from the front of the housing 2. If double-sided printing is performed on the medium P, after completion of recording on the first side of the medium P by the recording unit 8, the medium P is transported in the opposite direction by the transportation unit 33. That is, before the sheet ejection tray 12 is completely ejected, the medium P is transported in the direction that is the opposite of the transportation direction while being nipped between the first roller 52 and the second roller 54. When this reverse transportation is performed, the trailing edge of the medium P turns into the leading edge, and the medium P is transported toward the medium feeding unit 32, which is located at the side that is the opposite of the side in the transportation direction.

The medium P is fed again while being nipped between a refeeding roller 18 and the feeding roller 13 of the medium feeding unit 32. The medium P goes around the feeding roller 13 while being nipped by rollers arranged around the feeding roller 13, specifically, first by the refeeding roller 18, next by the first feeding driven roller 14*a*, and next by the second feeding driven roller 14*b*. By going around the feeding roller 13 in this way, the medium P is turned over, meaning that the second side that is the back of the first side faces up. Then, the medium P is transported to the recording unit 8 by the transportation unit 33. Recording is performed on the second side by the recording head 10. After the recording, the medium P is ejected onto the sheet ejection tray 12 provided at the front portion of the apparatus.

Gap Adjuster

Figure 5:
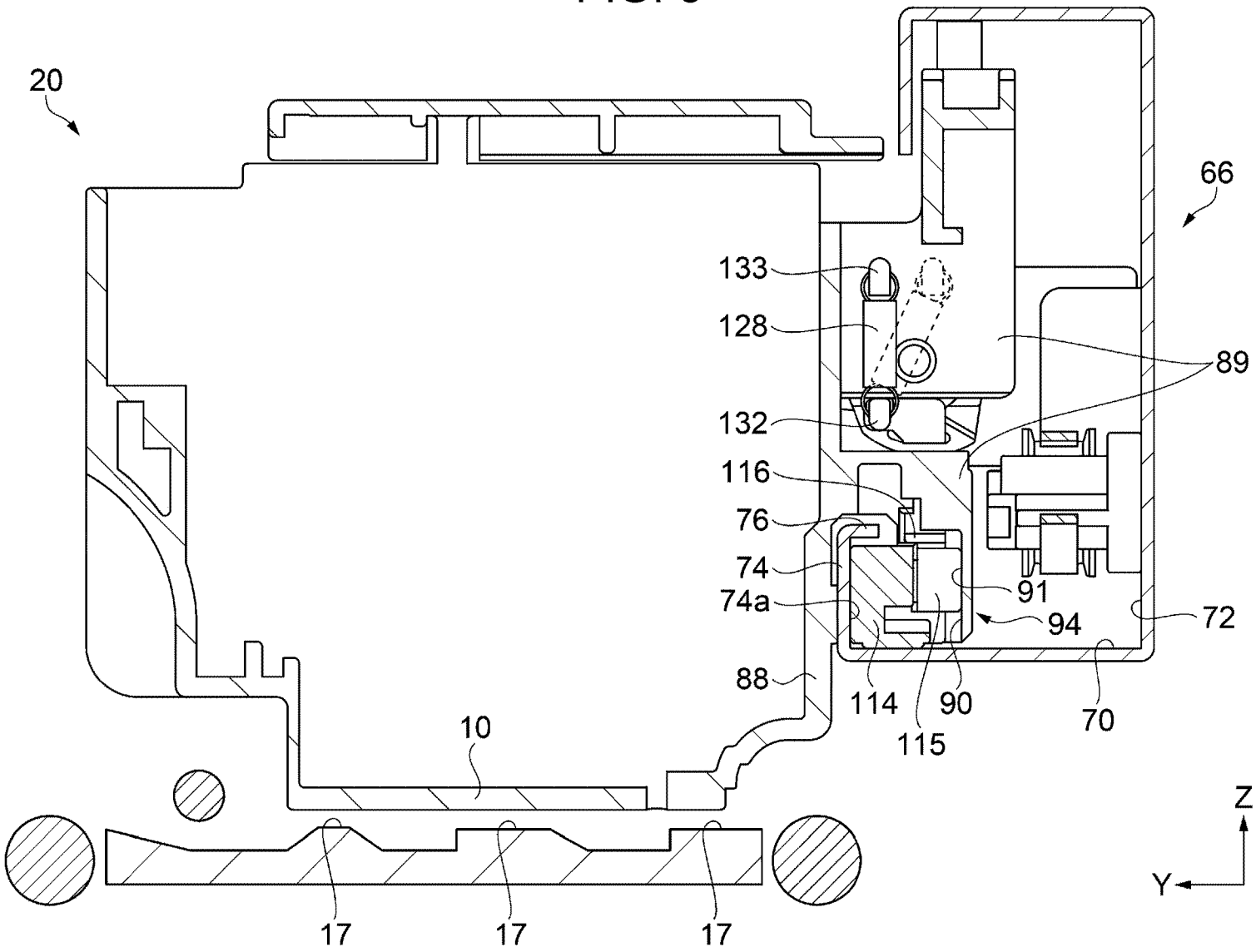
FIG. 5 is a sectional view of the printer unit taken along a plane parallel to the YZ plane.

An overview explanation of a gap adjuster is given first with reference to FIG. 5. The gap adjuster 94 is provided at an engagement portion where a portion protruding rearward from the back 88 of the housing of the carriage 20 is engaged with the guide member 66 provided behind this portion. The carriage 20 on which the recording head 10 is mounted is supported by the guide member 66 via the gap adjuster 94. The guide member 66 is fastened with screws to a non-illustrated apparatus frame provided behind it. The guide member 66 includes a guide slide surface 70, which extends in the width direction and forms the bottom surface of the guide member 66, a guide supporting surface 72 rising in the Z direction from the rear end of the guide slide surface 70, a guide surface 74*a* rising in the Z direction from the front end of the guide slide surface 70, and a restriction surface 76 extending rearward from the upper end of the guide surface 74*a*.

A plate-shaped back member 74, as a part of the guide member 66, is in contact with the back 88 of the housing of the carriage 20 and has the guide surface 74*a* on its back. The place where the gap adjuster 94 is provided has a structure of protruding rearward from the back 88 of the housing of the carriage 20 to cover the back member 74 and extending to a position near the guide slide surface 70, thereby being surrounded by walls in the Y direction and the Z direction. This engagement portion surrounded by walls on four sides between the back 88 of the housing of the carriage 20 and the guide member 66 will be hereinafter referred to as a house portion 89. The gap adjuster 94 is built in the house portion 89.

Figure 7:
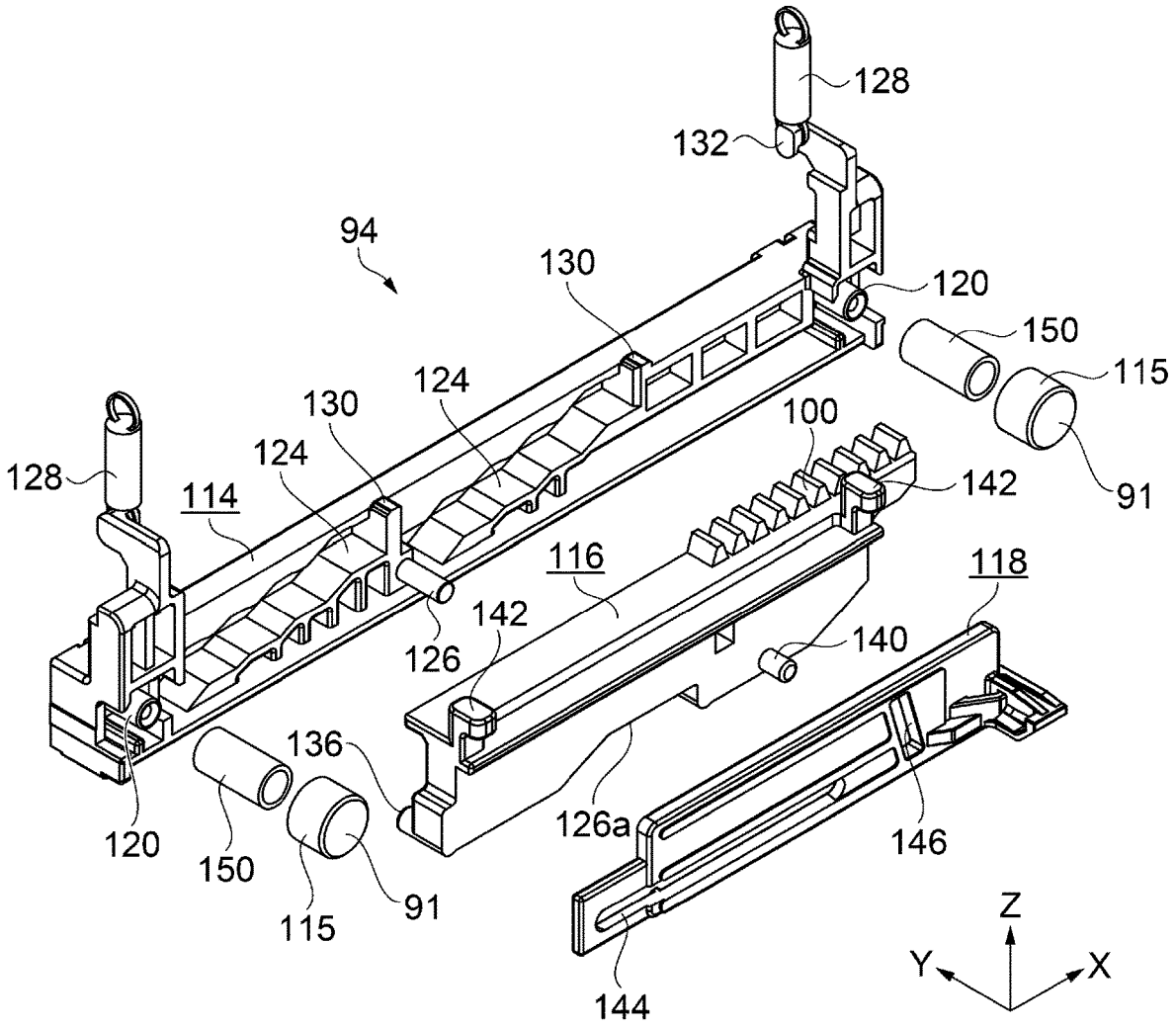
FIG. 7 is an exploded view of the gap adjuster.

The gap adjuster 94 includes a slide member 114 that slides while being in contact with the guide slide surface 70. The gap adjuster 94 further includes a receiving surface 90 that is an inner wall facing the back 88 of the housing of the carriage 20 in the house portion 89, in addition to the slide member 114. As illustrated in FIG. 7, the gap adjuster 94 includes a coil spring 150 sandwiched between the slide member 114 and the receiving surface 90. The coil spring 150 is an example of a first urging member. Therefore, the receiving surface 90 that is the inner wall of the house portion 89 as a part of the carriage 20 is able to reciprocate the gap adjuster 94 together with the carriage 20 in the width direction while being urged with respect to the slide member 114 by the coil spring 150 in the direction that is the opposite of the transportation direction.

Figure 6:
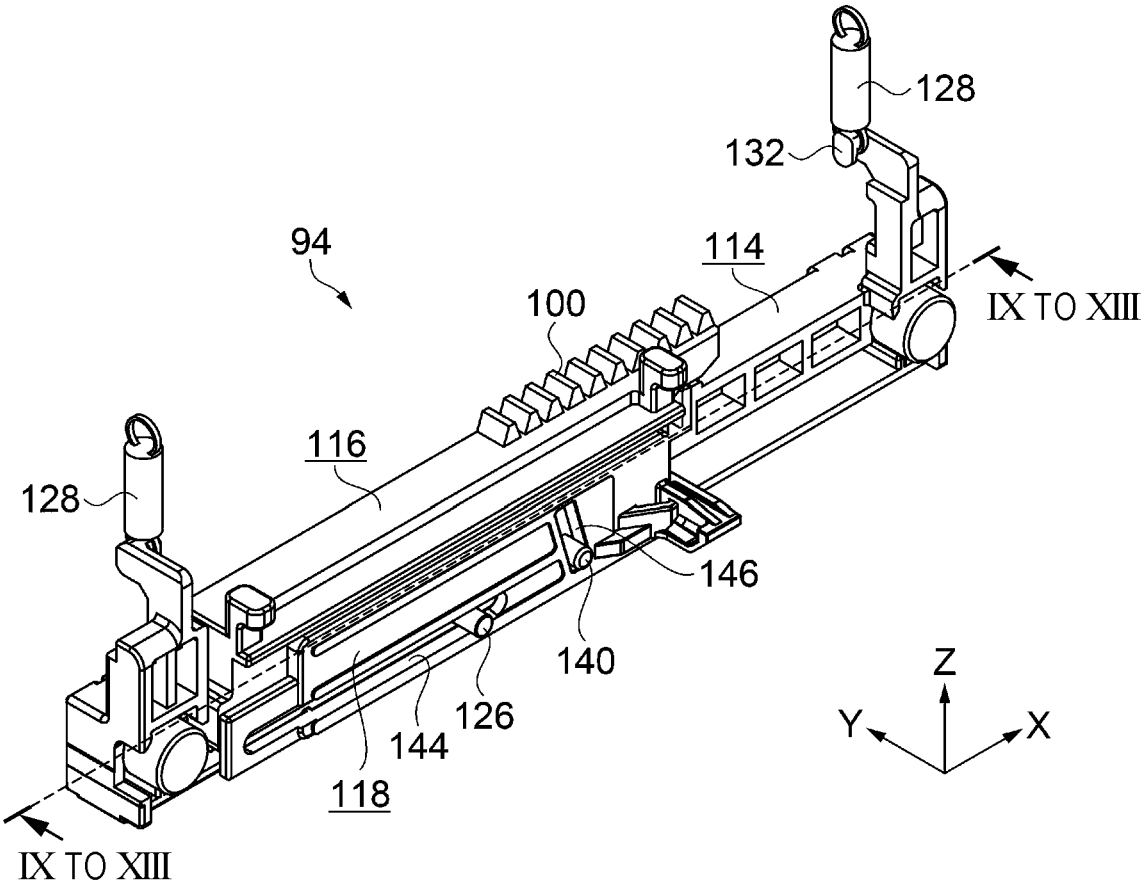
FIG. 6 is an entire perspective view of a gap adjuster.
Figure 8:
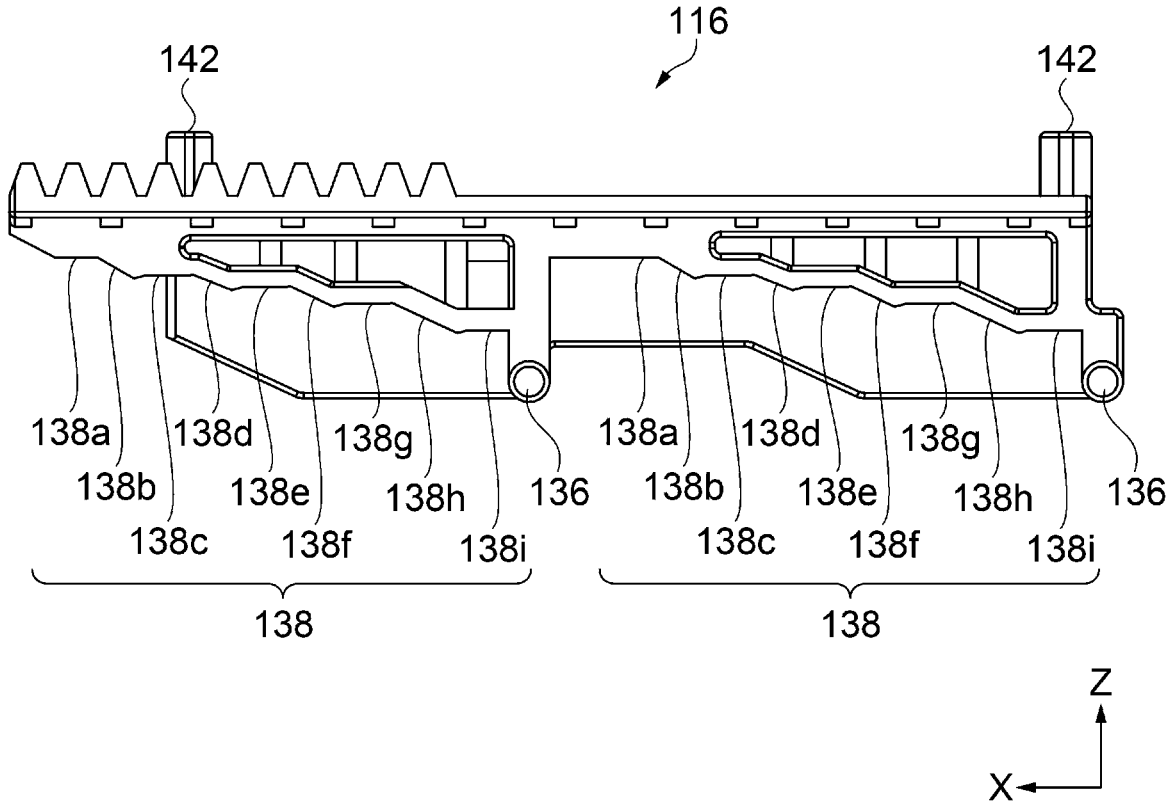
FIG. 8 is a plan view of a cam member.

FIG. 6 is an overall perspective view of the gap adjuster 94 taken out of the house portion 89. FIG. 7 is an exploded perspective view of the gap adjuster 94 illustrated in FIG. 6, shown with parts taken apart. FIG. 8 is a plan view of a cam member 116 described later, viewed in the direction that is the opposite of the transportation direction. With reference to FIGS. 5 to 8, the structure and operation of the gap adjuster 94 will now be explained. As illustrated in FIG. 7, the gap adjuster 94 includes the slide member 114, the receiving surface 90, the coil spring 150, the cam member 116, and an engagement member 118. The cam member 116 is in engagement between the slide member 114 and the receiving surface 90. The engagement member 118 is engaged with the cam member 116. The front of the slide member 114 is in contact with the guide surface 74*a* that is the back of the back member 74 that is a part of the guide member 66. The slide member 114 has two engagement portions 124 like two flights of steps at its back next to each other in the width direction. A first engagement pin 126 to be inserted through a cutout portion 126*a* of the cam member 116, which is located behind the slide member 114, is provided at a position between the two stairway-like engagement portions 124. The slide member 114 has a contact portion 130 on its top extending further up from the end face of the top one of the steps of each of the two stairway-like engagement portions 124.

The slide member 114 has a pair of protrusions 120 at its left and right ends in its rear portion. The protrusion 120 protrudes in the direction that is the opposite of the transportation direction. The protrusion 120 is inserted into the coil spring 150. The end of the pair of coil springs 150 is capped with a left-and-right pair of slide contact members 115 each having a shape of a cap. The head of the slide contact member 115 has a sliding surface 91 for sliding on the receiving surface 90 of the carriage 20. As illustrated in FIG. 5, the receiving surface 90 of the carriage 20 slides on the slide contact member 115 smoothly in the Z direction at the time of adjusting the gap between the supporting surface 17, which supports the medium P, and the recording head 10. Such smooth Z-directional sliding prevents the coil spring 150 from buckling.

A tension spring 128 that is an example of a second urging member is provided over each of portions protruding up from the left and right ends of the slide member 114. The tension spring 128 urges the slide member 114 with respect to the carriage 20 in the vertical direction that is an example of a first direction. A first hook portion 132 for providing a hook for the tension spring 128 is provided on each of the portions protruding up from the left and right ends of the slide member 114. The first hook portion 132 is an example of a first connection portion. As illustrated in FIG. 5, one end of the tension spring 128 is hooked on the first hook portion 132 on the top end portion of the slide member 114. Second hook portions 133 are provided on left and right outer walls of the house portion 89 of the carriage 20. The other end of the tension spring 128 is hooked on the second hook portion 133. The second hook portion 133 is an example of a second connection portion. Since the coil spring 150 provided on the slide member 114 always urges the receiving surface 90 of the carriage 20, there is possibility that a smooth change in position of the carriage 20 in the Z direction is obstructed when the gap is adjusted into a certain gap value. To prevent this state, the tension spring 128 is provided on the first hook portion 132, which is connected to the slide member 114, and on the second hook portion 133. The tension spring 128 always urges the carriage 20 anchored to the slide member 114 upward. Therefore, the carriage 20 is able to change its position in the Z direction smoothly on the slide contact member 115 provided on the slide member 114.

The slide member 114 is pressed against the guide slide surface 70 of the guide member 66 due to the own weight of the carriage 20. This prevents the carriage 20 from becoming ungrounded from the guide slide surface 70 when the carriage 20 reciprocates in the X direction. As illustrated in FIG. 5, in a default state, the second hook portions 133 provided on the left and right outer walls of the house portion 89 of the carriage 20 are configured to enable hooking thereon along the vertical direction with respect to the first hook portions 132 of the slide member 114. However, as indicated by the broken-line illustration in FIG. 5, the second hook portions 133 provided on the left and right outer walls of the house portion 89 of the carriage 20 may be configured to enable hooking thereon at comparatively rear position with respect to the first hook portions 132 of the slide member 114. That is, the tension springs 128 are inclined upstream in the transportation direction from the first hook portions 132 of the slide member 114 and are hooked on the second hook portions 133 provided on the left and right outer walls of the house portion 89 of the carriage 20. Due to the resilience of the tension spring 128 hooked on the second hook portion 133 at the comparatively rear position of the carriage 20, this produces an urging force in the direction that is the opposite of the transportation direction via the first hook portion 132 of the slide member 114. That is, the tension spring 128 is able to assist in urging the receiving surface 90 of the carriage 20 in the direction that is the opposite of the transportation direction by the coil spring 150 provided on the slide member 114.

Figure 14:
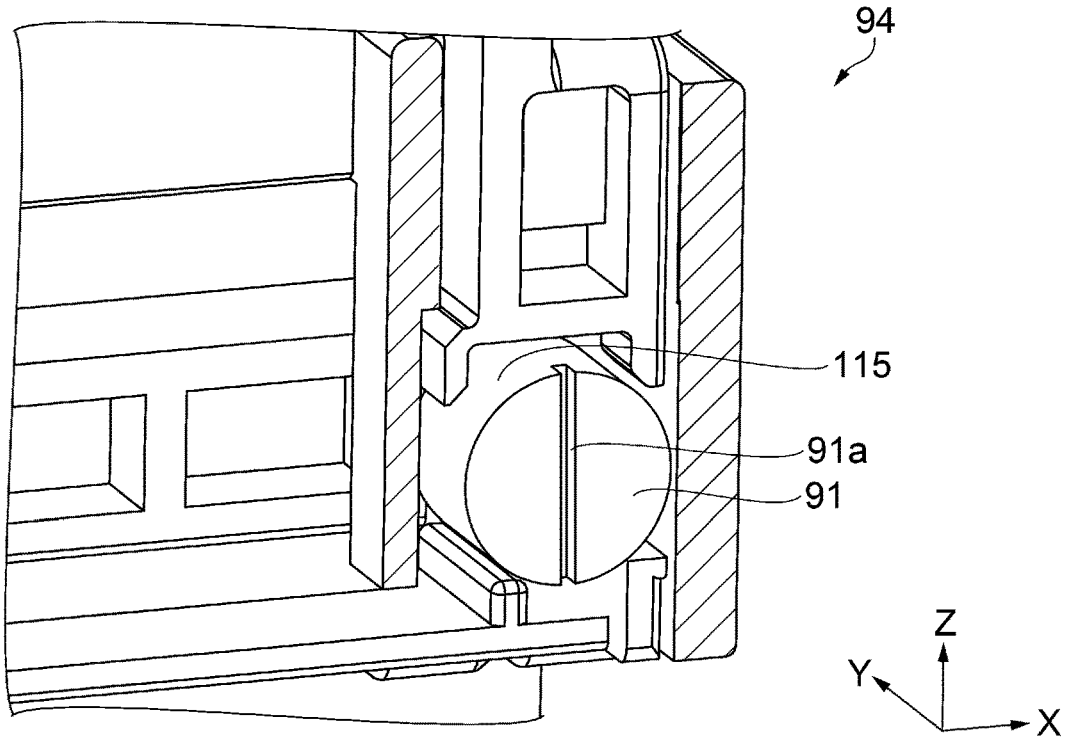
FIG. 14 is a diagram showing another example of the structure of a slide contact member.

A lubricant may be applied to the sliding surface 91 in order to improve the ease of sliding. As illustrated in FIG. 14, the sliding surface 91 may have a groove 91*a* for retaining a lubricant as an example of a structure for always supplying a lubricant to the sliding surface 91. As another example of a structure, though not illustrated in the drawing, one or more recessed pit portions may be provided in the sliding surface 91 so as to improve the ease of sliding.

Figure 15:
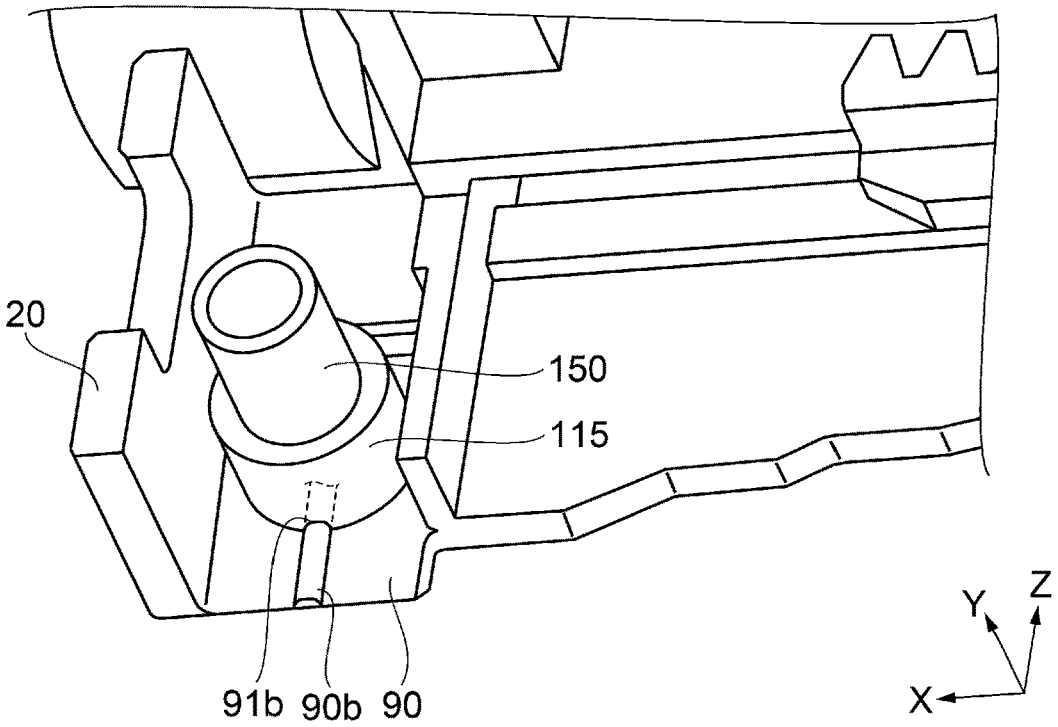
FIG. 15 is a diagram showing another example of the structure of a slide contact surface and a receiving surface.
Figure 16:
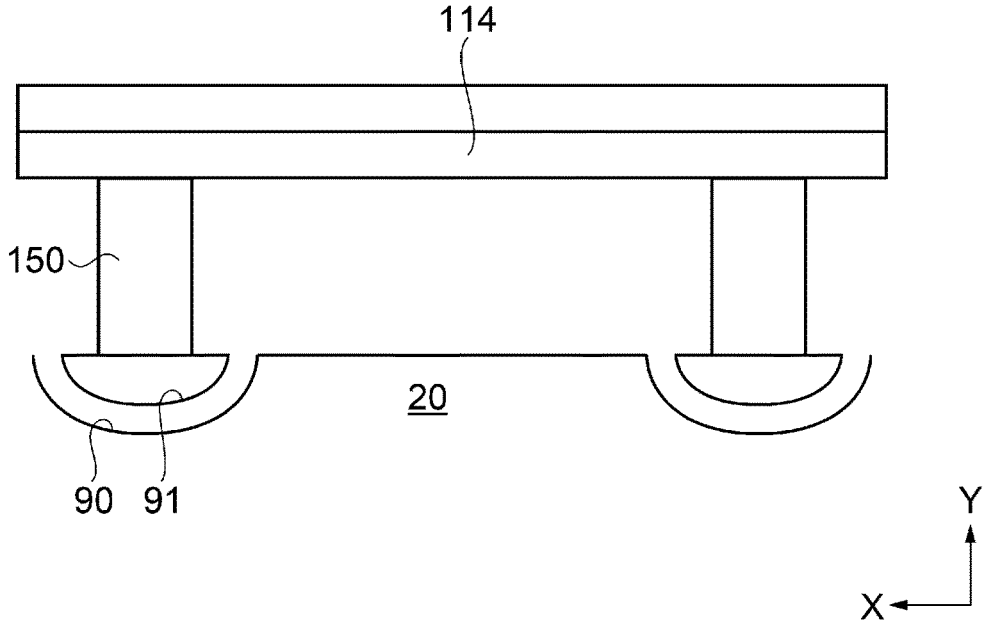
FIG. 16 is a diagram showing another example of the structure of a slide contact surface and a receiving surface.

As still another example of a structure, the ease of sliding may be improved by providing a concave portion 91*b* extending in the vertical direction in the sliding surface 91 as an example of one surface and by providing a convex portion 90*b* on the receiving surface 90 as an example of the other surface for mating with the concave portion 91*b* as illustrated in FIG. 15. The opposite pattern is also possible. Though not illustrated, the ease of sliding may be improved by providing a concave portion extending in the vertical direction in the receiving surface 90 as an example of one surface and by providing a convex portion on the sliding surface 91 as an example of the other surface for mating with the concave portion. As still another example of a structure, the ease of sliding may be improved by forming an arc-curved convex sliding surface 91 as an example of one surface and by forming an arc-curved concave receiving surface 90 as an example of the other surface for mating with the sliding surface 91 as illustrated in FIG. 16. The opposite pattern is also possible. Though not illustrated, the ease of sliding may be improved by forming an arc-curved convex receiving surface 90 as an example of one surface and by forming an arc-curved concave sliding surface 91 as an example of the other surface for mating with the receiving surface 90.

In the present embodiment, the load of the left one of the coil springs 150 is the same as the load of the right one. However, springs with spring constants different from each other may be used for the coil springs 150. If the load of the left one of the coil springs 150 is the same as the load of the right one as in the present embodiment, operating noise produced at the time of gap adjustment tends to be large. Specifically, the urging force of the left one of the coil springs 150 and the urging force of the right one of the coil springs 150 provide support for maintaining the gap between the supporting surface 17, which supports the medium P, and the recording head 10 by a left-and-right pair of stepped portions 138 of the cam member 116, which will be described later, and by two contact portions 130 of the slide member 114, which are engaged with the stepped portions 138. Therefore, if the load of the left one of the coil springs 150 is the same as the load of the right one, falling from a step on the left side and from a step on the right side occurs simultaneously at the two contact portions 130 engaged with the stepped portions 138, resulting in large falling noise. By contrast, if the urging forces applied by the coil springs 150 at the respective ends of the slide member 114 in the width direction are different from each other, falling at the contact portions 130 occurs non-simultaneously for the left one and the right one of the pair of stepped portions 138 of the cam member 116. Since the left fall and the right fall do not occur simultaneously, it is possible to make the timing of generation of falling noise asynchronous. Therefore, it is possible to make falling noise generated during the operation of the gap adjuster 94 smaller.

Figure 9:
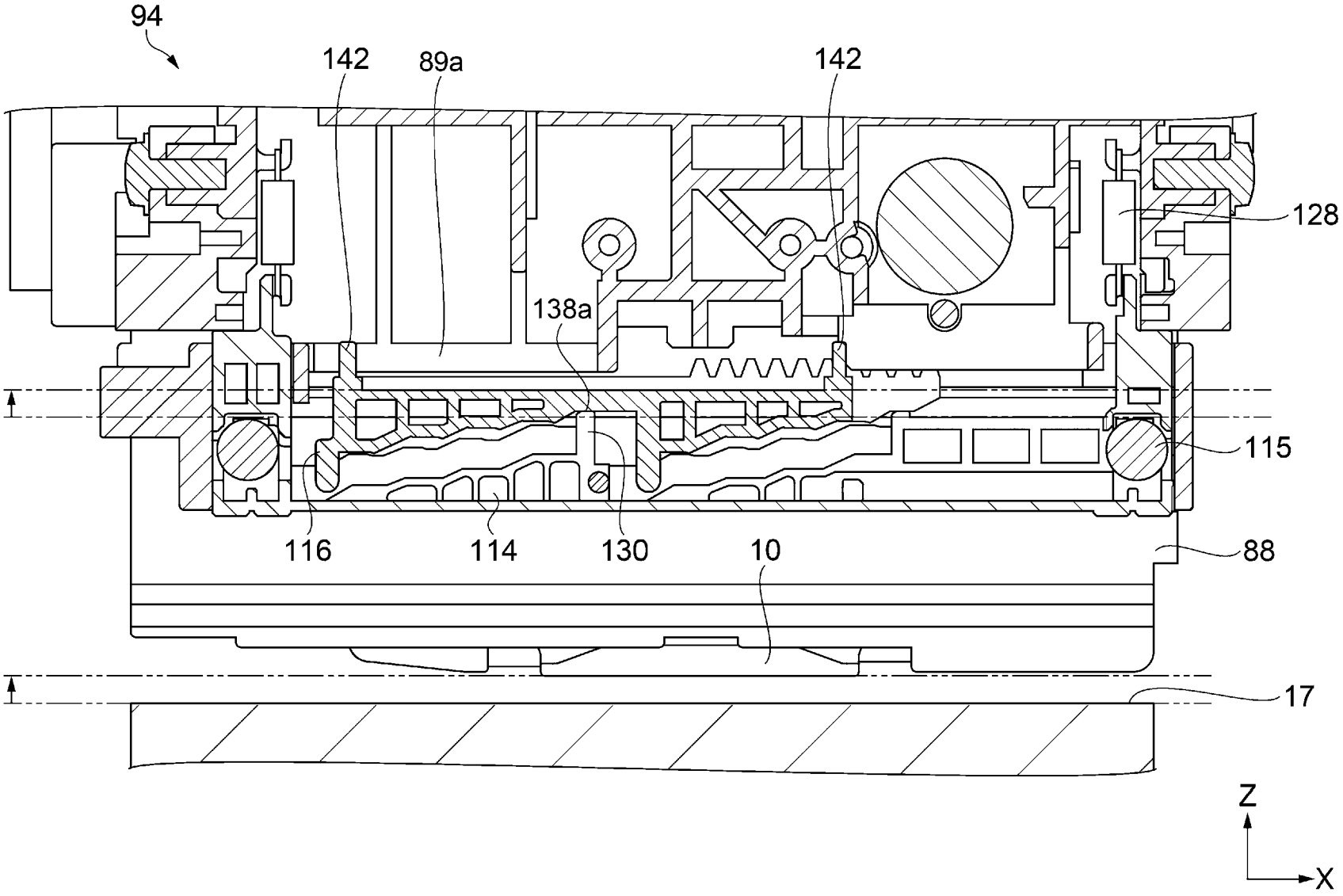
FIG. 9 is a diagram showing switching to a first level portion of the gap adjuster.

As illustrated in FIGS. 5, 6, and 7, the cam member 116 arranged behind the slide member 114 is located between the receiving surface 90 of the carriage 20 and the slide member 114. As illustrated in FIG. 8, the cam member 116 has the left-and-right pair of stepped portions 138 with alternate-arrangement structure in the width direction on its side of contact with the slide member 114. A second engagement pin 136 is provided on a lowest end portion extending further down from the end face of the lowest one of the steps of each of the two the stepped portions 138. As illustrated in FIG. 7, the second engagement pin 136 is engaged with the stairway-like engagement portion 124 of the slide member 114 and enables the cam member 116 to slide in the X direction. The cam member 116 further has a pair of upper engagement portions 142 on the left and right ends of its top. As illustrated in FIG. 9, the upper engagement portion 142 is engaged with a guide groove 89*a*, which is provided at the top portion of the house portion 89 of the carriage 20 along the X direction, so as to prevent the cam member 116 from coming off from the house portion 89 of the carriage 20.

As illustrated in FIG. 7, the engagement member 118 arranged behind the cam member 116 has a guide groove 144, which extends in the X direction, and an elongated hole 146, which extends in the Z direction with X-directional inclination. As illustrated in FIG. 6, the first engagement pin 126 of the slide member 114 is engaged with the guide groove 144 of the engagement member 118 through the cutout portion 126*a* of the cam member 116. As illustrated in FIG. 7, the cam member 116 has a third engagement pin 140 on its side that is the opposite of the side of contact with the slide member 114. The third engagement pin 140 of the cam member 116 is engaged with the elongated hole 146 of the engagement member 118.

Since the first engagement pin 126 of the slide member 114 is engaged with the guide groove 144 of the engagement member 118 as illustrated in FIG. 6, the position of the engagement member 118 and the slide member 114 does not change in the Z direction when the engagement member 118 is slid in the X direction. However, the cam member 116 moves in the Z direction with X-directionally-inclined operation of the third engagement pin 140 along the elongated hole 146 of the engagement member 118. Namely, the sliding of the engagement member 118 causes the movement of the cam member 116 and the engagement member 118 together in the X direction and causes a change in position of the cam member 116 only in the Z direction by an amount corresponding to the height of the elongated hole 146 approximately. The change in position in the Z direction is a change in height level of the second engagement pin 136 of the cam member 116 from the lowest one to the top one of the steps of the stairway-like engagement portion 124 of the slide member 114.

As illustrated in FIGS. 6 and 7, the gap adjuster 94 fulfills its function by combination of the slide member 114, the cam member 116, and the engagement member 118. The power of a motor is transmitted via a non-illustrated pinion gear engaged with a rack 100 provided on the top surface of the cam member 116. Gap adjustment is performed by receiving this motor power. A case where, for example, the gap between the supporting surface 17, which supports the medium P, and the recording head 10 is increased by moving the cam member 116 in the direction from the tail toward the head of the X-directional arrow will now be described.

The motor power transmitted via the pinion gear to the rack 100 causes the cam member 116 to move in the X direction. The cam member 116 is able to move in the X direction by a movement distance corresponding to the length of the guide groove 89*a*, which is provided at the top portion of the house portion 89 of the carriage 20 along the X direction. When the cam member 116 moves in the X direction, the cam member 116 causes its second engagement pin 136 to change in position upward while being in engagement with the stairway-like engagement portion 124 of the slide member 114. As mentioned earlier, the upper engagement portion 142 of the cam member 116 is engaged with the house portion 89 of the carriage 20. Therefore, the carriage 20 changes in position upward together with the cam member 116.

With reference to FIGS. 8 to 13, the gap adjusted by operation of the gap adjuster 94 between the supporting surface 17, which supports the medium P, and the recording head 10 will now be explained. The gap adjuster 94 has the same stepped structure on its left portion and right portion as described above and causes these two sets of the structure to perform the same operation abreast with each other. Therefore, an explanation is given below for one set only. The gap adjuster 94 illustrated in FIGS. 9 to 13 are shown at a cross section taken along the X-directional line IX-IX to XIII-XIII of FIG. 6.

As illustrated in FIG. 8, the cam member 116 has a cam portion on its side of contact with the slide member 114, wherein the cam portion includes the stepped portion 138 with level differences in the vertical direction, with alternate slope and non-slope arrangement in the width direction. The stepped portion 138 of the cam member 116 is made up of keeping surfaces for keeping the carriage position in the vertical direction and adjustment surfaces for sloped connection between these keeping surfaces and for changing the carriage position in the vertical direction. More specifically, the stepped portion 138 includes a first level portion 138*a*, a second level portion 138*c*, a third level portion 138*e*, a fourth level portion 138*g*, and a fifth level portion 138*i* as surfaces for keeping the gap, and includes a first sloped portion 138*b*, a second sloped portion 138*d*, a third sloped portion 138*f*, and a fourth sloped portion 138*h* as surfaces for adjusting the gap. The level portions 138*a*, 138*c*, 138*e*, 138*g*, and 138*i* and the sloped portions 138*b*, 138*d*, 138*f*, and 138*h* are arranged alternately in the width direction to constitute the stepped structure.

Any one of the first level portion 138*a*, the second level portion 138*c*, the third level portion 138*e*, the fourth level portion 138*g*, and the fifth level portion 138*i* engages with the contact portion 130 of the slide member 114 to define the gap and keep the gap. The first sloped portion 138*b*, the second sloped portion 138*d*, the third sloped portion 138*f*, and the fourth sloped portion 138*h* change the gap when the cam member 116 slides with respect to the slide member 114.

The contact portion 130 comes into engagement with the level portions 138*a*, 138*c*, 138*e*, 138*g*, and 138*i* in this order when the cam member 116 slides with respect to the slide member 114 in the X direction. The contact portion 130 comes into engagement with the level portions 138*i*, 138*g*, 138*e*, 138*c*, and 138*a* in this order when the cam member 116 slides with respect to the slide member 114 in the opposite direction along the X direction. By this means, it is possible to change the gap distance.

Next, each gap will now be explained. FIG. 9 illustrates a state in which the first level portion 138*a* of the stepped portion 138 of the cam member 116 is in contact with the contact portion 130 of the slide member 114. When in this state, the height of the first level portion 138*a* in the Z direction specifies the minimum setting of the gap between the recording head 10 and the supporting surface 17 for supporting the medium P. This gap is set when, for example, recording is performed on glossy paper for photo use.

Figure 10:
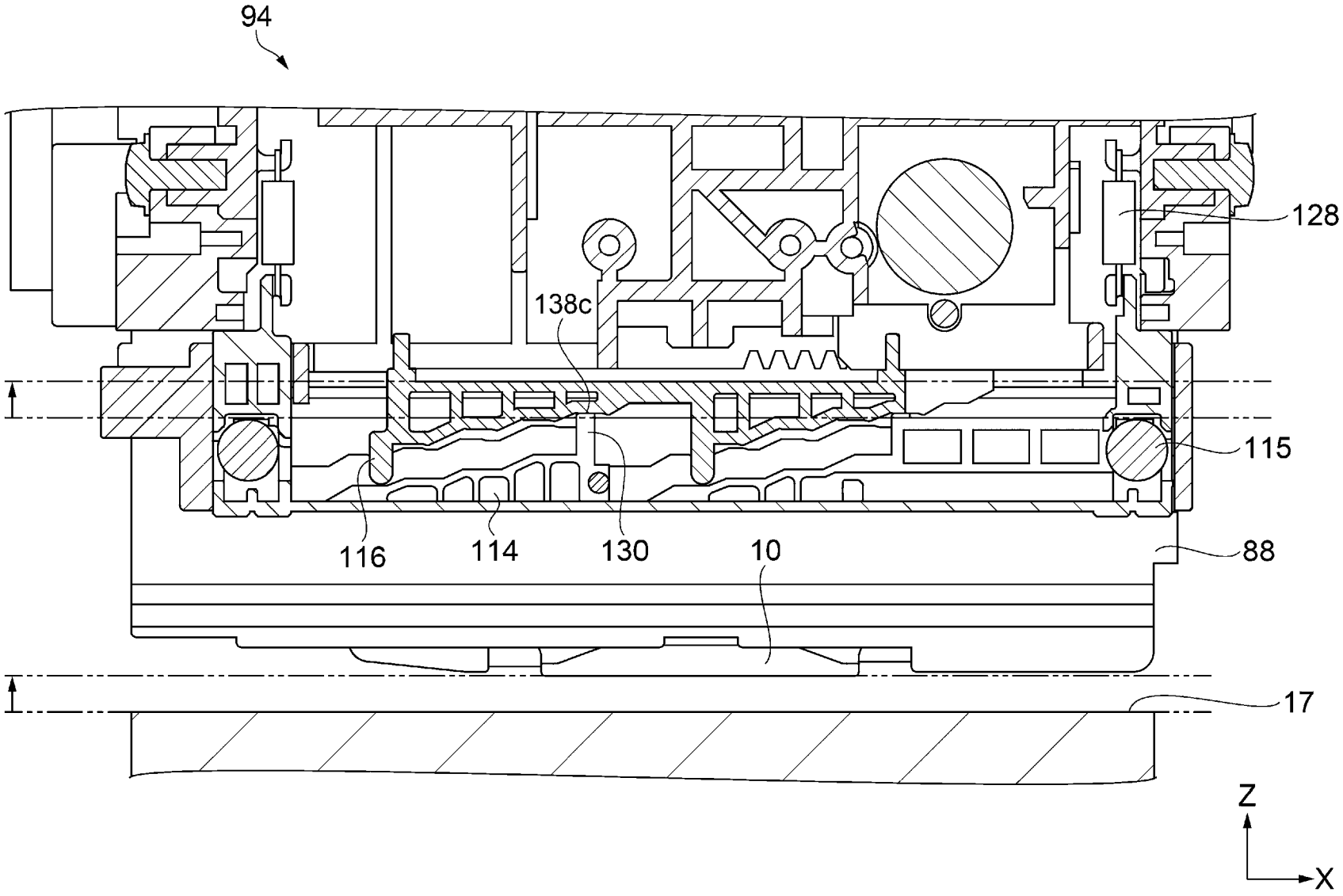
FIG. 10 is a diagram showing switching to a second level portion of the gap adjuster.

Next, FIG. 10 illustrates a state in which the second level portion 138*c* of the stepped portion 138 of the cam member 116 is in contact with the contact portion 130 of the slide member 114. When in this state, the height of the second level portion 138*c* in the Z direction specifies that the position of the carriage 20 is changed up by one step from the minimum setting of the gap between the recording head 10 and the supporting surface 17 for supporting the medium P. This gap is set when, for example, recording is performed on plain paper. In addition, this gap is set in order to avoid so-called scratching if the scratching contact of the recording head 10 has occurred in recording performed on glossy paper for photo use with the minimum setting.

Figure 11:
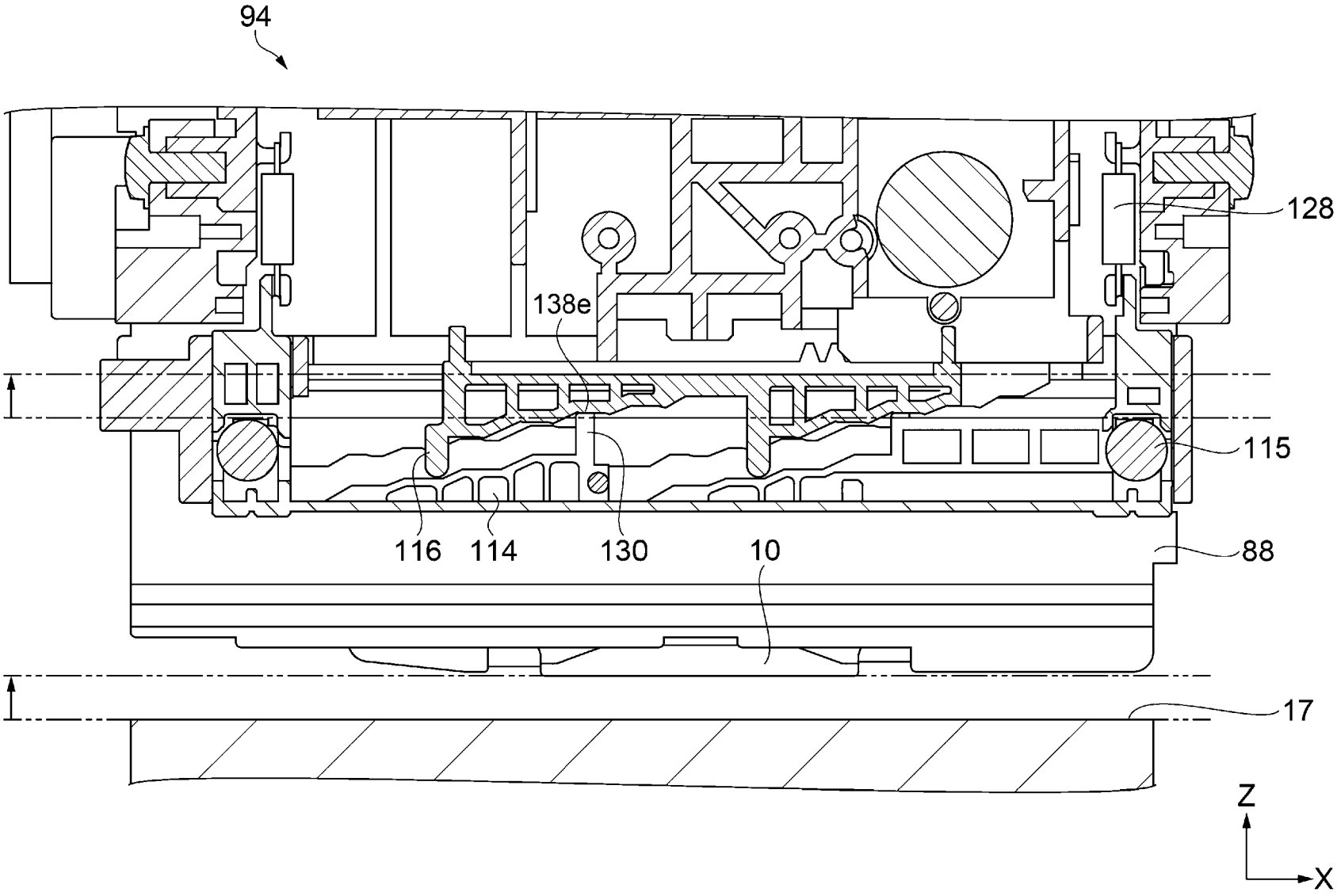
FIG. 11 is a diagram showing switching to a third level portion of the gap adjuster.

Next, FIG. 11 illustrates a state in which the third level portion 138*e* of the stepped portion 138 of the cam member 116 is in contact with the contact portion 130 of the slide member 114. When in this state, the height of the third level portion 138*e* in the Z direction specifies that the position of the carriage 20 is changed up by two steps from the minimum setting of the gap between the recording head 10 and the supporting surface 17 for supporting the medium P. For example, this gap is set in order to avoid scratching if scratching contact has occurred in recording performed on plain paper with the one-step-raised setting described above.

Figure 12:
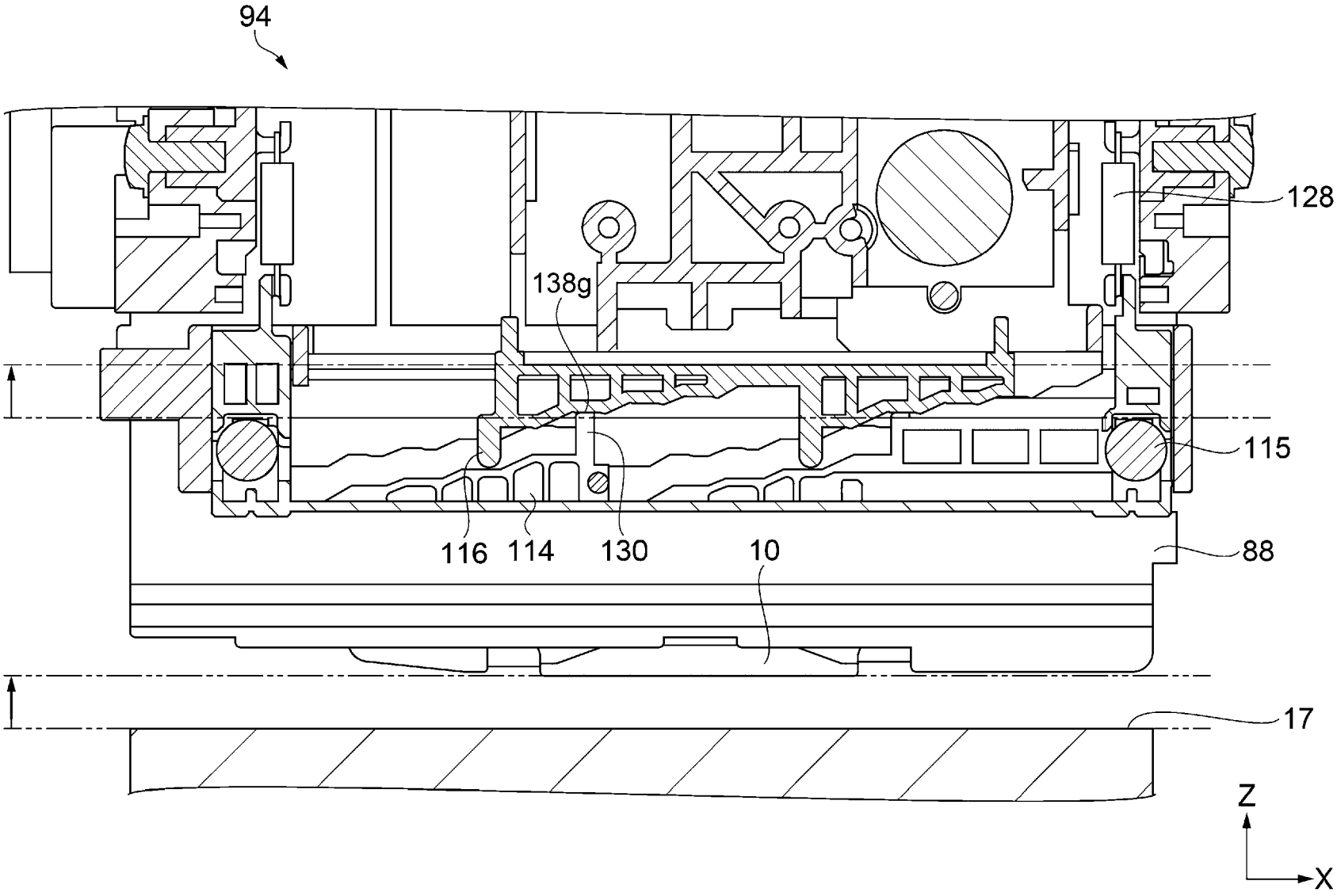
FIG. 12 is a diagram showing switching to a fourth level portion of the gap adjuster.

Next, FIG. 12 illustrates a state in which the fourth level portion 138*g* of the stepped portion 138 of the cam member 116 is in contact with the contact portion 130 of the slide member 114. When in this state, the height of the fourth level portion 138*g* in the Z direction specifies that the position of the carriage 20 is changed up by three steps from the minimum setting of the gap between the recording head 10 and the supporting surface 17 for supporting the medium P. This gap is set when, for example, recording is performed on thick paper such as cardboard paper.

Figure 13:
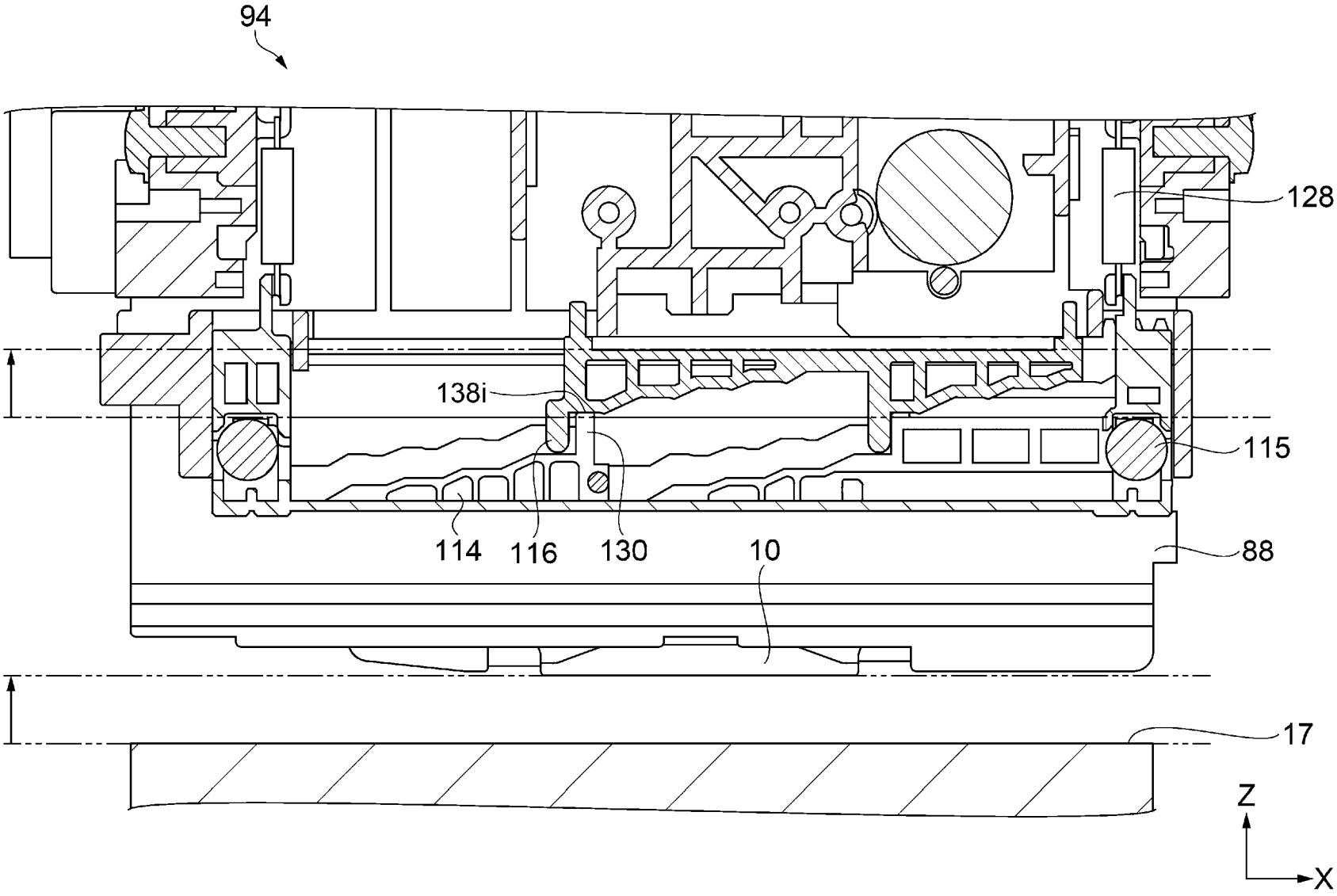
FIG. 13 is a diagram showing switching to a fifth level portion of the gap adjuster.

Next, FIG. 13 illustrates a state in which the fifth level portion 138*i* of the stepped portion 138 of the cam member 116 is in contact with the contact portion 130 of the slide member 114. When in this state, the height of the fifth level portion 138*i* in the Z direction specifies the maximum setting of the gap between the recording head 10 and the supporting surface 17 for supporting the medium P. This gap is set when, for example, label recording is performed on CD, etc.

Figure 17:
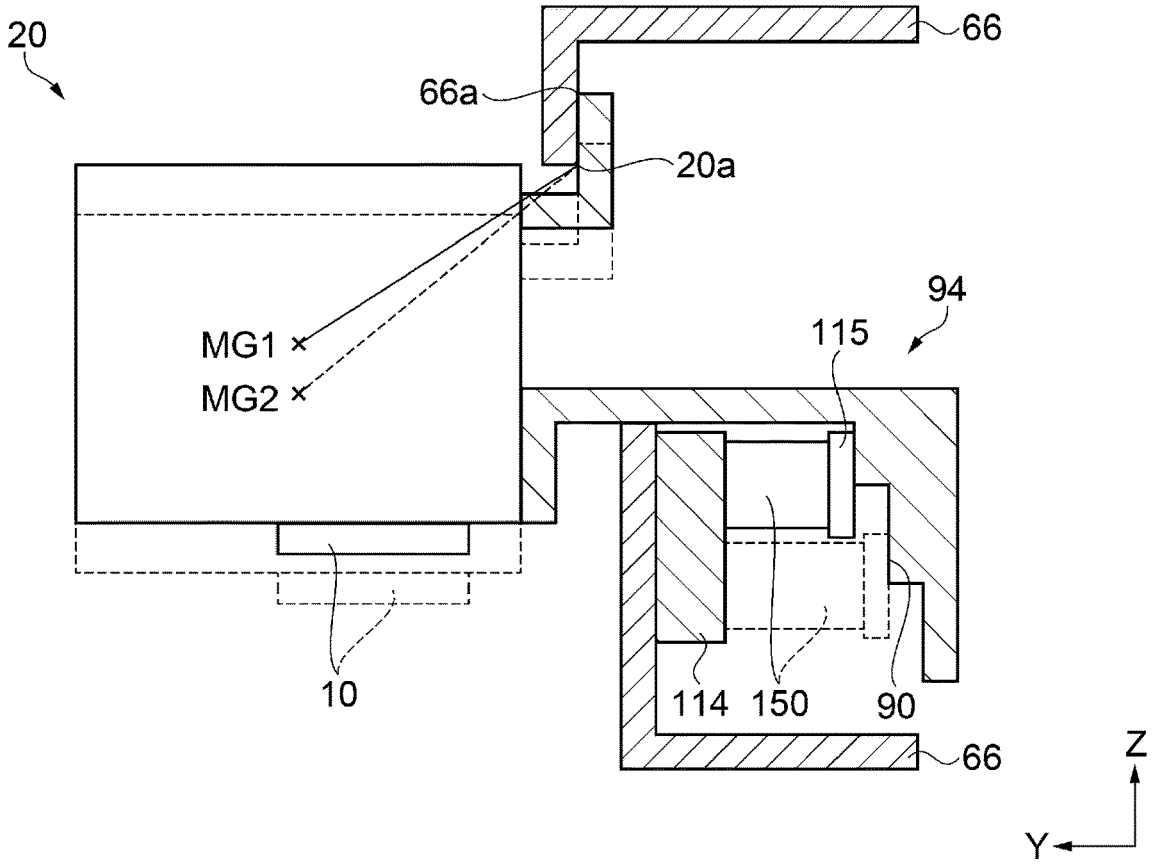
FIG. 17 is a diagram for explaining a moment of a carriage and a stepped receiving surface.

As illustrated in FIG. 17, in the gap adjuster 94 according to the present embodiment, moment that is applied to an upper supporting surface 66*a* extending vertically down in the direction of gravity from the upper portion of the guide member 66 and applied to an upper slide surface 20*a* of the carriage 20 that is in contact with the upper supporting surface 66*a* changes due to the change in position of the carriage 20 in the Z direction. For example, suppose that the position of the carriage 20 changes in the Z direction from the position indicated by solid-line illustration to broken-line illustration in FIG. 17 due to gap adjustment. The center of gravity MG1 of the carriage 20 changes to the center of gravity MG2. Since the fulcrum of rotation, on the upper slide surface 20*a*, remains the same, the length of the line segment connecting the upper slide surface 20*a* to the center of gravity MG2 is greater than the length of the line segment connecting the upper slide surface 20*a* to the center of gravity MG1. This means that the moment changes as a result of the change in position of the carriage 20 in the Z direction. For this reason, if the urging force of the coil spring 150 applied to the receiving surface 90 of the carriage 20 does not change, the moment applied to the carriage 20 changes. In order to keep the moment applied to the carriage 20 by the gap adjuster 94 constant, steps in the Z direction, which is an example of a first direction, are provided in the receiving surface 90 of the house portion 89 of the carriage 20. By this means, the gap adjuster 94 is able to balance the moment applied to the carriage 20 by increasing or decreasing the urging force of the coil spring 150 in relation to the change in position of the carriage 20 in the Z direction.

As explained above, the following effects can be obtained from the ink-jet multifunction printer 1 according to an exemplary embodiment of the present disclosure. In the ink-jet multifunction printer 1, the guide member 66 extending in the width direction is provided, and the recording head 10 mounted on the carriage 20 performs recording on the medium P supported on the supporting surface 17 while the carriage 20 is scanned in the width direction. The ink-jet multifunction printer 1 includes the gap adjuster 94. The gap adjuster 94 changes in the vertical direction a gap between the recording head 10 and the supporting surface 17, which is a surface for supporting the medium P at a position facing the recording head 10. The gap adjuster 94 includes the slide member 114 and the cam member 116. The slide member 114 moves in the width direction together with the carriage 20. The cam member 116 is provided between the carriage 20 and the slide member 114 and has the stepped portion 138 in which keeping surfaces and adjustment surfaces are arranged alternately in the width direction. The slide member 114 of the gap adjuster 94 has the pair of protrusions 120 at its left and right ends in its rear portion. The coil springs 150 are provided around the protrusions 120. The coil springs 150 urge the carriage 20 with respect to the slide member 114 in the direction that is the opposite of the transportation direction.

In the ink-jet multifunction printer 1, the slide contact member 115 is provided between the end of each coil spring 150 of the slide member 114 and the receiving surface 90 of the carriage 20. This structure prevents the end of the coil spring 150 from getting caught on the receiving surface 90 of the carriage 20. Therefore, the gap between the recording head 10 and the supporting surface 17 for supporting the medium P is made stable, resulting in improved print quality.

In the ink-jet multifunction printer 1, the protrusions 120 provided on the slide member 114 protrude into the coil springs 150 respectively. This structure reduces a relative deviation of the central axes of the slide contact member 115 and the coil spring 150. Furthermore, this structure makes the coil spring 150 unlikely to buckle when gap adjustment is performed, and makes the gap between the recording head 10 and the supporting surface 17 for supporting the medium P stable, resulting in improved print quality.

In the ink-jet multifunction printer 1, the slide contact member 115 is provided between the end of each coil spring 150 of the slide member 114 and the receiving surface 90 of the carriage 20. A groove for retaining a lubricant is provided in the sliding surface 91 of the slide contact member 115 that is in sliding contact with the receiving surface 90 of the carriage 20. Since the groove is provided, in the ink-jet multifunction printer 1, a lubricant is applied between the receiving surface 90 of the carriage 20 and the sliding surface 91 of the slide contact member 115, and the lubricant reduces a friction coefficient and thus makes it possible to perform smooth sliding. Therefore, the gap between the recording head 10 and the supporting surface 17 for supporting the medium P is made stable, resulting in improved print quality.

In the ink-jet multifunction printer 1, the center of gravity of the carriage 20 changes as a result of changing the position of the carriage 20 by the gap adjuster 94. However, the fulcrum of rotation, on the upper slide surface 20*a*, remains the same. Therefore, a moment expressed as a line segment connecting the fulcrum of rotation, on the upper slide surface 20*a*, to the center of gravity of the carriage 20 changes. If there were no change in the urging force of the coil spring 150 applied to the receiving surface 90 of the carriage 20 despite the fact that the moment changes due to the change in the position of the carriage 20 in the Z direction, the moment applied to the carriage 20 would not be constant. For a solution, steps in the Z direction are provided in the receiving surface 90 of the carriage 20. By this means, the ink-jet multifunction printer 1 is able to balance the moment applied to the carriage 20 by increasing or decreasing the urging force of the coil spring 150 in relation to the change in position of the carriage 20 in the Z direction. Therefore, the gap between the recording head 10 and the supporting surface 17 for supporting the medium P is made stable, resulting in improved print quality.

In the ink-jet multifunction printer 1, either a concave portion extending in the vertical direction or a convex portion extending in the vertical direction is provided in or on one of the sliding surface 91 of the slide contact member 115 and the receiving surface 90 of the carriage 20, and the concave portion and the convex portion mate with each other. This structure prevents the slide contact member 115 from getting caught on the receiving surface 90 of the carriage 20. Therefore, the gap between the recording head 10 and the supporting surface 17 for supporting the medium P is made stable, resulting in improved print quality.

In the ink-jet multifunction printer 1, the slide contact member 115 is provided between the end of each coil spring 150 of the slide member 114 and the receiving surface 90 of the carriage 20. The ink-jet multifunction printer 1 has a shape for reducing a friction coefficient between the sliding surface 91 of the slide contact member 115 and the receiving surface 90. In the ink-jet multifunction printer 1, either an arc-curved convex surface or an arc-curved concave surface is provided on or in one of the sliding surface 91 of the slide contact member 115 and the receiving surface 90 of the carriage 20, and the arc-curved convex surface and the arc-curved concave surface mate with each other. This structure prevents the sliding surface 91 of the slide contact member 115 from getting caught on the receiving surface 90 of the carriage 20. Therefore, the gap between the recording head 10 and the supporting surface 17 for supporting the medium P is made stable, resulting in improved print quality.

In the ink-jet multifunction printer 1, the tension spring 128, which urges the slide member 114 with respect to the carriage 20 in the vertical direction, is provided as an example of a second urging member over each of portions protruding up from the left and right ends of the slide member 114 of the gap adjuster 94. However, if an urging force of urging the carriage 20 is insufficient, in the ink-jet multifunction printer 1, the second hook portion 133 provided on the outer wall of the house portion 89 of the carriage 20 may be provided at such a position that the tension spring 128 is hooked thereon with upstream inclination in the transportation direction with respect to the vertical direction. Due to the resilience of the tension spring 128 hooked on the second hook portion 133 at the comparatively rear position of the carriage 20, this produces an urging force in the direction that is the opposite of the transportation direction via the first hook portion 132 of the slide member 114. That is, the tension spring 128 is able to assist in urging the receiving surface 90 of the carriage 20 in the direction that is the opposite of the transportation direction by the coil spring 150 provided on the slide member 114. Therefore, the gap between the recording head 10 and the supporting surface 17 for supporting the medium P is made stable, resulting in improved print quality.

In the ink-jet multifunction printer 1, normally, the carriage 20 is supported by means of urging forces applied by the left-and-right pair of coil springs 150, and the urging force of the left one of the coil springs 150 and the urging force of the right one of the coil springs 150 provide support for maintaining the gap between the supporting surface 17, which supports the medium P, and the recording head 10 by the left-and-right pair of stepped portions 138 of the cam member 116 and by the two contact portions 130 of the slide member 114, which are engaged with the stepped portions 138. Therefore, if the load of the left one of the coil springs 150 is the same as the load of the right one, large falling noise will be produced when falling from a step on the left side and from a step on the right side occurs simultaneously at the two contact portions 130 engaged with the stepped portions 138.

In the ink-jet multifunction printer 1, spring constants, etc. are made different from each other so that the urging forces applied by the coil springs 150 at the respective ends of the slide member 114 in the width direction will be different from each other, and, accordingly, falling at the contact portions 130 occurs non-simultaneously for the left one and the right one of the pair of stepped portions 138 of the cam member 116. Since the left fall and the right fall do not occur simultaneously, it is possible to make the timing of generation of falling noise asynchronous. For this reason, the ink-jet multifunction printer 1 makes it possible to make falling noise that is generated during the operation of the gap adjuster 94 smaller. Therefore, the ink-jet multifunction printer 1 realizes a reduction in noise that will make the user feel uncomfortable.

What is claimed is:

1. A recording apparatus, comprising:

a recording head that performs recording on a medium that is transported;

a carriage on which the recording head is mounted and which is configured to move in a width direction intersecting with a transportation direction of the medium;

a guide member that extends in the width direction and guides the carriage in the width direction; and a gap adjuster that causes the carriage to change in position in a first direction in which a gap between the recording head and a supporting surface for supporting the medium at a position facing the recording head changes, the gap adjuster including a slide member that moves in the width direction together with the carriage while sliding on the guide member;

a cam member provided between the carriage and the slide member and having a stepped portion; and a first urging member that urges the carriage with respect to the slide member in a direction that is opposite of the transportation direction; wherein the first urging member is equipped with a slide contact member that slides on the carriage.

2. The recording apparatus according to claim 1, wherein the first urging member is a coil spring, and the slide member has a protrusion protruding into the coil spring.

3. The recording apparatus according to claim 1, wherein the slide contact member has a sliding surface for sliding on the carriage, and a groove for retaining a lubricant is provided in the sliding surface.

4. The recording apparatus according to claim 3, wherein the carriage has a receiving surface for sliding on the sliding surface, and steps in the first direction are provided in the receiving surface.

5. The recording apparatus according to claim 4, wherein a concave portion extending in the first direction is provided in one of the sliding surface and the receiving surface, and a convex portion that mates with the concave portion is provided on the other of the sliding surface and the receiving surface.

6. The recording apparatus according to claim 5, wherein one of the sliding surface and the receiving surface is an arc-curved concave surface, and the other of the sliding surface and the receiving surface is an arc-curved convex surface.

7. The recording apparatus according to claim 1, wherein the gap adjuster includes a second urging member that urges the slide member with respect to the carriage in the first direction, and a second connection portion, of the second urging member, connected to the carriage is located comparatively upstream in the transportation direction in comparison with a first connection portion connected to the slide member.

8. The recording apparatus according to claim 1, wherein the first urging member is provided on both ends of the slide member in the width direction, with urging forces different from each other.

* * * * *